US008092277B2

(12) United States Patent
Hashii et al.

(10) Patent No.: US 8,092,277 B2
(45) Date of Patent: Jan. 10, 2012

(54) METHOD OF GRINDING SEMICONDUCTOR WAFERS, GRINDING SURFACE PLATE, AND GRINDING DEVICE

(75) Inventors: Tomohiro Hashii, Saga (JP); Yasunori Yamada, Saga (JP); Yuichi Kakizono, Saga (JP)

(73) Assignee: Sumco Corporation, Tokyo (JP)

( * ) Notice: Subject to any disclaimer, the term of this patent is extended or adjusted under 35 U.S.C. 154(b) by 462 days.

(21) Appl. No.: 12/470,714

(22) Filed: May 22, 2009

(65) Prior Publication Data

US 2009/0298396 A1 Dec. 3, 2009

(30) Foreign Application Priority Data

May 28, 2008 (JP) ..... 2008/140018

(51) Int. Cl.
*B24B 1/00* (2006.01)
*B24B 7/17* (2006.01)

(52) U.S. Cl. ..... 451/41; 451/57; 451/262; 451/548

(58) Field of Classification Search ..... 451/57, 451/58, 262, 548, 287, 261, 269, 540, 41, 451/63

See application file for complete search history.

(56) References Cited

U.S. PATENT DOCUMENTS 5,496,209 A * 3/1996 Gaebe ..... 451/548
6,129,609 A * 10/2000 Ripper et al. ..... 451/8
6,852,003 B2 * 2/2005 Tajima et al. ..... 451/6
7,429,209 B2 * 9/2008 Horisaka et al. ..... 451/37
2002/0115387 A1 * 8/2002 Wenski et al. ..... 451/41
2007/0158308 A1 7/2007 Koyata et al.

FOREIGN PATENT DOCUMENTS

JP 11-165254 6/1999
JP 2002-254299 9/2002
JP 2009-004616 1/2009
JP 2009-4616 1/2009

OTHER PUBLICATIONS

English language Abstract and translation of JP 2002-254299, Sep. 10, 2002.
English language Abstract and translation of JP 2009-4616, Jan. 8, 2009.
U.S. Appl. No. 12/470,961 to Yamada et al., filed May 22, 2009.

* cited by examiner

*Primary Examiner* — Dung Van Nguyen
(74) *Attorney, Agent, or Firm* — Greenblum & Bernstein P.L.C.

(57) ABSTRACT

A method of grinding semiconductor wafers including simultaneously grinding both surfaces of multiple semiconductor wafers by rotating the wafers between a pair of upper and lower rotating surface plates in a state where the wafers are held on a carrier so that centers of the wafers are positioned on a circumference of a single circle, wherein a ratio of an area of a circle passing through the centers of the wafers to an area of one of the wafers is greater than or equal to 1.33 but less than 2.0; surfaces of the fixed abrasive grains comprised in the surface plates are comprised of pellets disposed in a grid-like fashion, with the pellets provided in a center portion and pellets provided in a peripheral portion being larger in size than the pellets provided in an intermediate portion.

8 Claims, 6 Drawing Sheets

METHOD OF GRINDING SEMICONDUCTOR WAFERS, GRINDING SURFACE PLATE, AND GRINDING DEVICE

CROSS-REFERENCE TO RELATED APPLICATIONS

This application claims the benefit of priority under 35 USC 119 to Japanese Patent Application No. 2008-140018, filed on May 28, 2008, which is expressly incorporated herein by reference in its entirety.

BACKGROUND OF THE INVENTION

1. Field of the Invention

The present invention relates to a grinding method for semiconductor wafers. More particularly, it relates to a wafer grinding method suited to large silicon wafers having a diameter of about 450 mm that employ a carrier to simultaneously grind both sides of a wafer between upper and lower surface plates. The present invention further relates to a semiconductor grinding surface plate and device suitable for use in the above method.

2. Discussion of the Background of the Invention

In the simultaneous grinding of both surfaces of a wafer during the manufacturing of a semiconductor wafer from silicon or the like, anywhere from 1 to as many as about 10 workpieces (semiconductor wafers) are generally inserted into the carrier holding the work for grinding. The number of workpieces varies based on factors such as increasing productivity relating to device size, work diameter and the like; specifications that take into account the work track and permeation of abrasive solution; and the like.

Planetary gear-type devices can be employed in such grinding of both surfaces of semiconductor wafers. However, when a planetary gear-type grinding device is employed, outer circumference sagging (peripheral sagging) occurs, resulting in precluding the obtaining of wafers with a high degree of flatness. As a countermeasure to outer circumference sagging, a method seeking to improve flatness through carrier design is proposed in Japanese Unexamined Patent Publication (KOKAI) No. 2002-254299, which is expressly incorporated herein by reference in its entirety. This method is a technique (fixed dimension polishing) in which the thickness of a carrier is controlled with a high degree of precision so as to approach the final thickness of the work, to disperse stress acting on the outer circumference portion of the work into the carrier to obtain a flat work.

However, the method described in Japanese Unexamined Patent Publication (KOKAI) No. 2002-254299 does not prevent peripheral sagging of wafers.

Accordingly, the present inventors conducted extensive research into the relation between semiconductor wafers as works and the stress that acts on the carrier holding the semiconductor wafers. As a result, they discovered that by conducting polishing with a carrier in which the circle radius (PCD), which specifies the spacing of the holes as the radius of a circle passing through the center of the holes in the carrier, and/or in which the spacing between works, was set to within a prescribed range, it was possible to evenly disperse the pressure from the surface plates in the surface of the wafers to prevent peripheral sagging of wafers without diminishing productivity and without shortening the service life of the carrier.

The solution that was discovered was in the form of a device for polishing both surfaces of semiconductor wafers including a pair of upper and lower rotating surface plates; a sun gear provided in a rotating center portion between the upper and lower rotating surface plates; a ring-shaped inner-toothed gear positioned on an outer circumference portion between the upper and lower rotating surface plates; and a carrier made of a planetary gear, the planetary gear meshing with the inner-toothed gear and sun gear and being positioned between the upper and lower rotating surface plates, wherein the carrier has multiple holes serving as holes receiving wafers being polished, and centers of the multiple holes are positioned on a circumference of a single circle, with a ratio of an area of a circle passing through the centers of the multiple holes to an area of one of the wafers being polished greater than or equal to 1.33 but less than 2.0, and the above device is described in Japanese Unexamined Patent Publication (KOKAI) No. 2009-4616, published on Jan. 8, 2009, which is expressly incorporated herein by reference in its entirety.

A method of grinding semiconductor wafers including simultaneously polishing both surfaces of multiple semiconductor wafers being polished by rotating the multiple semiconductor wafers between a pair of upper and lower rotating surface plates in a state where the multiple semiconductor wafers are held on a carrier so that centers of the multiple semiconductor wafers are positioned on a circumference of a single circle, wherein a ratio of an area of a circle passing through the centers of the multiple semiconductor wafers to an area of one of the multiple semiconductor wafers is greater than or equal to 1.33 but less than 2.0, is also discussed in above-described Japanese Unexamined Patent Publication (KOKAI) No. 2009-4616.

The size of the silicon wafers cut from single crystals of silicon is increasing in an about a 10-year cycle. Device manufacturers hope to increase device manufacturing efficiency by increasing the size of the silicon wafers. In light of these circumstances, the manufacturing of silicon wafers with diameters of about 450 mm, about 1.5 times the current diameter of 300 mm, is planned for the near future.

Polishing of silicon wafers 450 mm in diameter will involve polishing of an area that is double or more that of conventional silicon wafers equal to or less than 300 mm in diameter. Thus, difficulty is anticipated in obtaining silicon wafers with the same flatness as in the past while maintaining production efficiency by the same method as before.

In particular, for silicon wafers 450 mm in diameter, it is difficult to obtain silicon wafers of the same flatness as in the past while maintaining production efficiency by the conventionally employed combination of lapping with free abrasive grains and grinding with fixed abrasive grains.

Mainstream conventional processing machinery includes an inner circumference gear and an outer circumference gear. With such machinery, there is a concern that quality will deteriorate due to differences in peripheral speed of the inner and outer circumferences.

In the semiconductor wafer polishing device in the above patent application, there is a mechanism that does not include an inner circumference gear, making it possible to increase the size of the device as the size of the wafer increases. Further, the wafer itself oscillates to cover the difference in peripheral speed of the inner and outer circumferences, and various pellets are arranged in individual areas of the wafer based on the dimensions of the surface plates and the like.

SUMMARY OF THE INVENTION

Thus, a non-limiting aspect of the present invention provides for a method and device permitting the obtaining with good production efficiency of silicon wafers having the same degree of flatness as in the past despite an increased diameter.

Accordingly, a non-limiting feature of the invention solves the deterioration of quality due to differences in peripheral speed of the inner and outer circumferences. The present inventors conducted extensive research into grinding large-diameter 450 mm silicon wafers—the next generation of silicon wafers—by adapting the semiconductor wafer polishing device of the above-cited patent application for use in grinding with fixed abrasive grains. As a result, it was discovered that the arrangement of the pellets in conventional grinding with fixed abrasive grains was uniform, only the outer portion of the wafer was ground down, the inner portion tended not to be ground down, resulting in that the surface at the center of the wafer ended up protruding. Various investigations were conducted into solving such protruding, a solution was discovered, and a non-limiting feature of the present invention was devised on that basis.

The present inventors conducted extensive research into solving the protruding at the center of the wafer surface. They discovered that such protruding was solved by adjusting the number of edges in the center portion and the number of edges on the peripheral portion of the fixed abrasive grain surface plates used in grinding; according to a non-limiting feature of the present invention was devised on that basis.

A first non-limiting aspect of the present invention relates to a method of grinding semiconductor wafers including:

simultaneously grinding both surfaces of multiple semiconductor wafers being ground by rotating the multiple semiconductor wafers between a pair of upper and lower rotating surface plates in a state where the multiple semiconductor wafers are held on a carrier so that centers of the multiple semiconductor wafers are positioned on a circumference of a single circle, wherein a ratio of an area of a circle passing through the centers of the multiple semiconductor wafers to an area of one of the multiple semiconductor wafers is greater than or equal to 1.33 but less than 2.0;

the rotating surface plates include fixed abrasive grains;

surfaces of the fixed abrasive grains are composed of pellets disposed in a grid-like fashion, with the pellets provided in a center portion and pellets provided in a peripheral portion being larger in size than the pellets provided in an intermediate portion between the center portion and the peripheral portion.

The pellets may be of square planar shape, and a length of one side of the pellets provided in the center and peripheral portions may range from 1.1 to 10 times a length of one side of the pellets provided in the intermediate portion.

A radial ratio of the center portion:intermediate portion: peripheral portion, may range from 1:0.5 to 2:0.5 to 2.

The semiconductor wafers may have a diameter ranging from 400 to 500 mm.

A second non-limiting aspect of the present invention relates to a semiconductor wafer grinding surface plate, including fixed abrasive grains, wherein, surfaces of the fixed abrasive grains facing a surface of a semiconductor wafer are composed of grid-like pellets, and the pellets provided in a center portion and peripheral portion are larger in size than the pellets provided in an intermediate portion between the center portion and the peripheral portion.

The pellets may be of square planar shape, and a length of one side of the pellets provided in the center and peripheral portions may range from 1.1 to 10-times a length of one side of the pellets provided in the intermediate portion.

A radial ratio of the center portion, intermediate portion, and peripheral portion, center portion: intermediate portion: peripheral portion, may range from 1:0.5 to 2:0.5 to 2.

A third non-limiting aspect of the present invention relates to a semiconductor wafer grinding device including:

a pair of upper and lower rotating surface plates;

a sun gear provided in a rotating center portion between the upper and lower rotating surface plates;

a ring-shaped inner-toothed gear positioned on an outer circumference portion between the upper and lower rotating surface plates; and a carrier composed of a planetary gear, the planetary gear meshing with the inner-toothed gear and sun gear and being positioned between the upper and lower rotating surface plates, wherein the carrier has multiple holes serving as holes receiving wafers being ground, centers of the multiple holes are positioned on a circumference of a single circle, with a ratio of an area of a circle passing through the centers of the multiple holes to an area of one of wafers being ground greater than or equal to 1.33 but less than 2.0, and the rotating surface plates are the surface plate according to the second aspect of the present invention.

According to a non-limiting feature of the present invention, even the large silicon wafers 450 mm in diameter that constitute the next generation of wafer can be ground to a high degree of flatness by grinding both surfaces with surface plates of fixed abrasive grains.

Other exemplary embodiments and advantages of the present invention may be ascertained by reviewing the present disclosure and the accompanying drawings.

BRIEF DESCRIPTION OF THE DRAWINGS

The present invention will be described in the following text by the exemplary, non-limiting embodiments shown in the figures, wherein:

FIG. 4-1 is a schematic drawing of a wafer surface;

FIG. 4-2 is a schematic drawing of a fixed abrasive grain surface; and

DETAILED DESCRIPTION OF THE EMBODIMENTS

Figure 1:
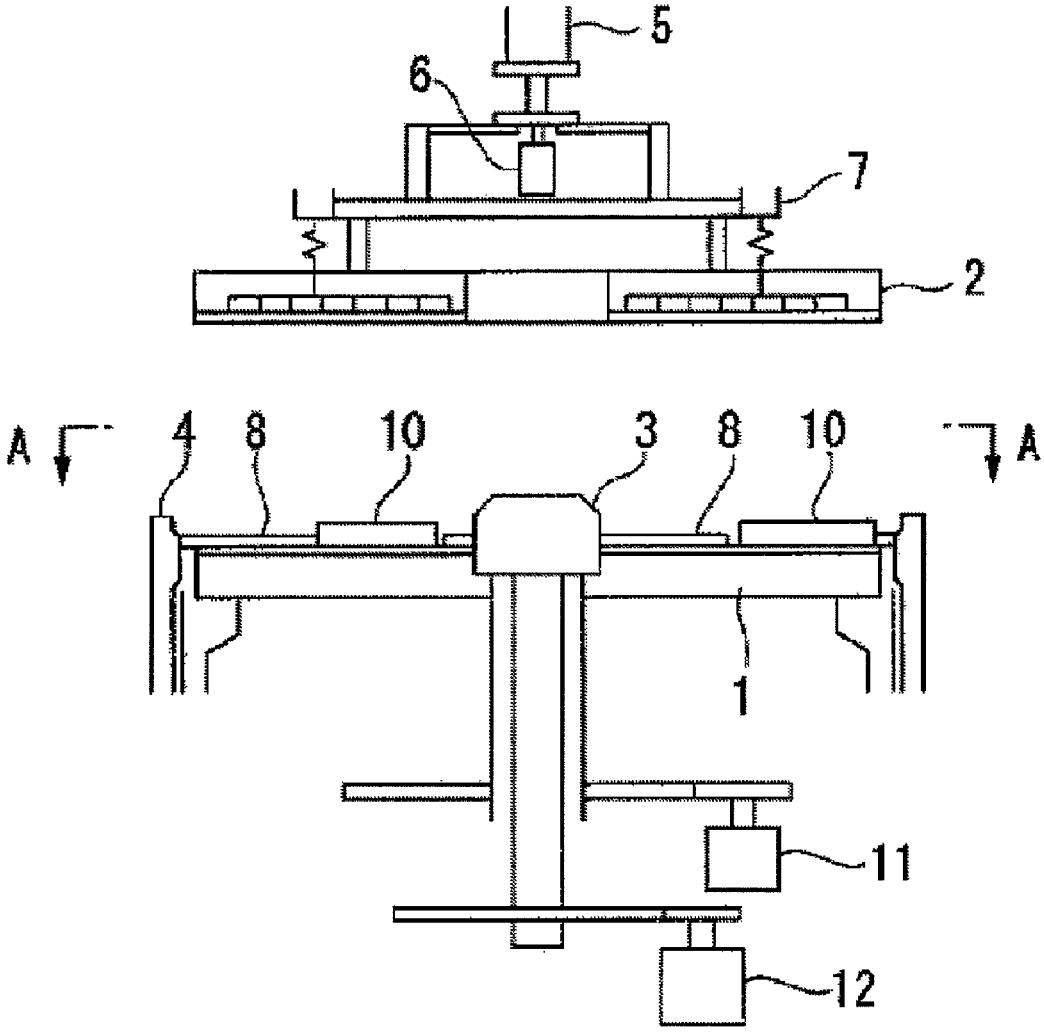
FIG. 1 is a front view descriptive of a non-limiting implementation embodiment of the semiconductor wafer grinding device employed in the present invention.

Unless otherwise stated, a reference to a compound or component includes the compound or component by itself, as well as in combination with other compounds or components, such as mixtures of compounds.

As used herein, the singular forms "a," "an," and "the" include the plural reference unless the context clearly dictates otherwise.

Except where otherwise indicated, all numbers expressing quantities of ingredients, reaction conditions, and so forth used in the specification and claims are to be understood as being modified in all instances by the term "about." Accordingly, unless indicated to the contrary, the numerical parameters set forth in the following specification and attached claims are approximations that may vary depending upon the desired properties sought to be obtained by the present invention. At the very least, and not to be considered as an attempt to limit the application of the doctrine of equivalents to the scope of the claims, each numerical parameter should be construed in light of the number of significant digits and ordinary rounding conventions.

Additionally, the recitation of numerical ranges within this specification is considered to be a disclosure of all numerical values and ranges within that range. For example, if a range is from about 1 to about 50, it is deemed to include, for example, 1, 7, 34, 46.1, 23.7, or any other value or range within the range.

The following preferred specific embodiments are, therefore, to be construed as merely illustrative, and non-limiting to the remainder of the disclosure in any way whatsoever. In this regard, no attempt is made to show structural details of the present invention in more detail than is necessary for fundamental understanding of the present invention; the description taken with the drawings making apparent to those skilled in the art how several forms of the present invention may be embodied in practice.

The first non-limiting aspect of the present invention relates to a method of grinding semiconductor wafers including simultaneously grinding both surfaces of multiple semiconductor wafers being ground by rotating the multiple semiconductor wafers between a pair of upper and lower rotating surface plates in a state where the multiple semiconductor wafers are held on a carrier so that centers of the multiple semiconductor wafers are positioned on a circumference of a single circle, wherein a ratio of an area of a circle passing through the centers of the multiple semiconductor wafers to an area of one of the multiple semiconductor wafers is greater than or equal to 1.33 but less than 2.0; the rotating surface plates include fixed abrasive grains; surfaces of the fixed abrasive grains are made of pellets disposed in a grid-like fashion, with the pellets provided in a center portion and pellets provided in a peripheral portion being larger in size than the pellets provided in an intermediate portion between the center portion and the peripheral portion.

The method of grinding semiconductor wafers according to a non-limiting feature of the present invention can be carried out, for example, with the device according to the third aspect of the present invention. The device includes a pair of upper and lower rotating surface plates; a sun gear provided in a rotating center portion between the upper and lower rotating surface plates; a ring-shaped inner-toothed gear positioned on an outer circumference portion between the upper and lower rotating surface plates; and a carrier composed of a planetary gear, the planetary gear meshing with the inner-toothed gear and sun gear and being positioned between the upper and lower rotating surface plates, wherein the carrier has multiple holes serving as holes receiving wafers being ground, centers of the multiple holes are positioned on a circumference of a single circle, with a ratio of an area of a circle passing through the centers of the multiple holes to an area of one of wafers being ground greater than or equal to 1.33 but less than 2.0.

As for the semiconductor wafer grinding method according to a non-limiting feature of the present invention, details regarding the fact that the positions at which the wafers are held within the carrier are disposed so that the centers of the multiple wafers are positioned on a circumference of a single circle and the fact that the ratio of an area of a circle passing through the centers of the multiple wafers to an area of one of the multiple wafers is greater than or equal to 1.33 but less than 2.0 will be described, with the details of the above grinding device further below.

In the semiconductor wafer grinding method according to a non-limiting feature of the present invention, the surfaces of fixed abrasive grains of the rotating surface plates are composed of pellets disposed in a grid-like fashion, with pellets provided in a center portion and pellets provided in a peripheral portion being larger in size than pellets provided in an intermediate portion between the center portion and the peripheral portion. The semiconductor wafer grinding method according to a non-limiting feature of the present invention can be carried out with the surface plate according to the second aspect of the present invention. The surface plate is employed for grinding semiconductor wafers, and includes fixed abrasive grains, wherein, surfaces of the fixed abrasive grains facing a surface of a semiconductor wafer are composed of grid-like pellets, and the pellets provided in a center portion and peripheral portion are larger in size than the pellets provided in an intermediate portion between the center portion and the peripheral portion.

In a common surface plate for grinding semiconductor wafers, pellets disposed in grid-like fashion are provided on a surface of fixed abrasive grains facing the surface of the wafer, with the size and disposition of the pellets being uniform. By contrast, in the semiconductor wafer grinding surface plate (according to a second non-limiting aspect of the present invention) employed in a feature of the present invention, the surfaces of fixed abrasive grains facing the surface of the wafer are composed of pellets disposed in grid-like fashion, as in the common semiconductor wafer grinding surface plate. However, in the surface plate according to a non-limiting feature of the present invention, the size of the pellets is not uniform: the pellets positioned in the center portion and peripheral portion are larger in size than the pellets provided in an intermediate portion (between the center portion and the peripheral portion).

Figures 1, 4:
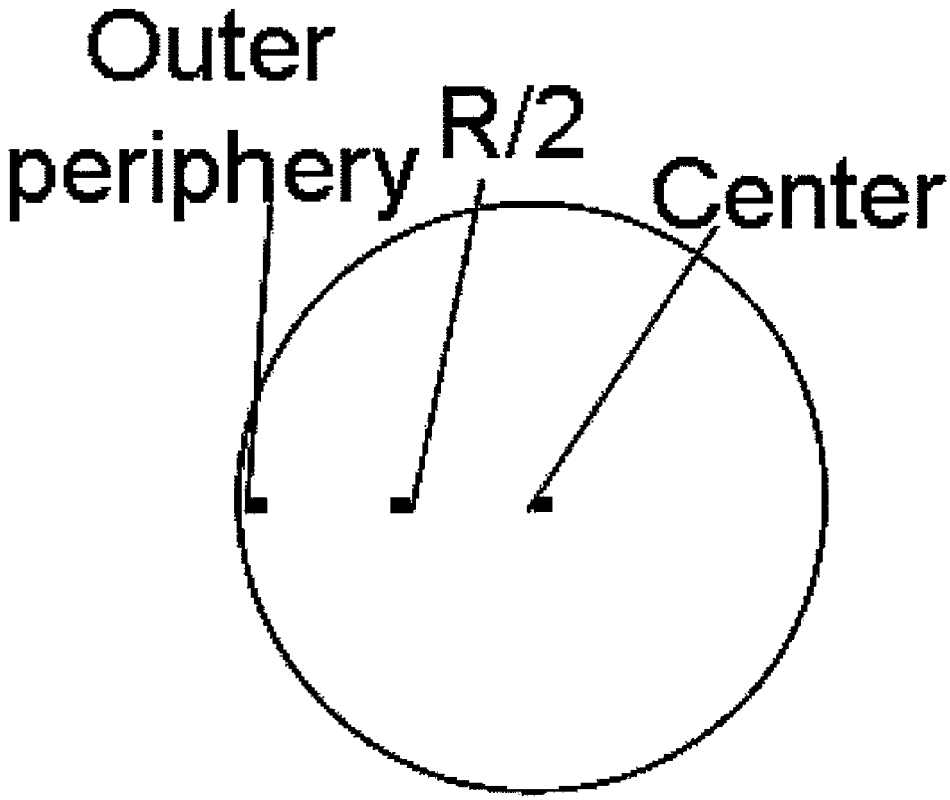
Figures 2, 4:
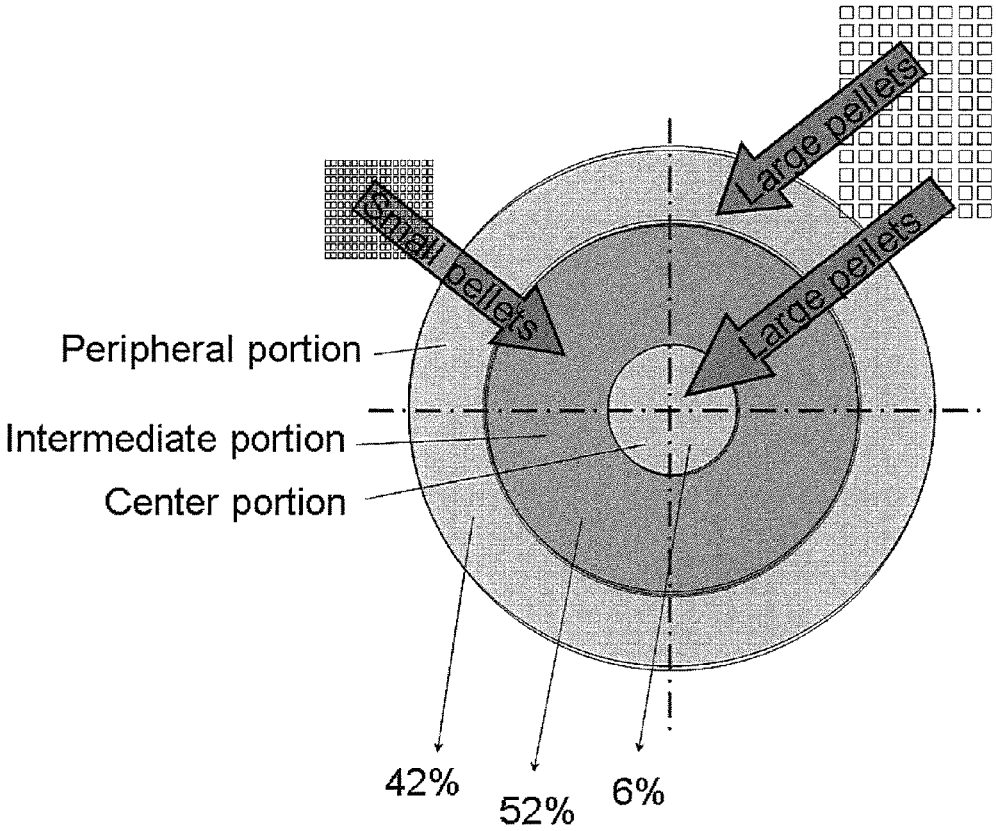

The size of the pellets provided in the center portion and the peripheral portion and the size of the pellets provided in the intermediate portion can be suitably determined by taking into account the circumferential speed at various positions on the wafer surface rotating during grinding. The circumferential speed at various positions on the wafer surface rotating during grinding will vary based on how the grinding device employed moves the wafer. In a non-limiting feature of the present invention, the wafer holding positions in the carrier are disposed so that the centers of multiple wafers are located on the circumference of a single circle, and so that the ratio of the area of a circle passing through the centers of the multiple wafers to the area of a single wafer is greater than or equal to 1.33 but less than 2.0. The results of measurements conducted with 450 mm wafers held as set forth above varied somewhat with the conditions, as shown in FIG. 4-1, when the circumferential speed at the center of the wafer was denoted as $\omega$, the circumferential speed at R(radius)/2 ranged from 1.2 to 1.6 $\omega$, and the circumferential speed at the outer perimeter ranged from 1.7 to 2 $\omega$. When the size of the pellets of the grinding surface plates was uniform, such difference in circumferential speed promoted grinding of the outer periphery relative to grinding of the center portion; that is, the grinding efficiency at the outer periphery was greater than the grinding efficiency in the center portion, resulting in the above-described poor flatness.

In the above grinding method according to a non-limiting feature of the present invention, the wafer itself can oscillate to cover the difference in circumferential speed at the inner and outer circumferences. However, the center portion remains in contact with the surface plates for a long period.

Thus, despite low grinding efficiency based on the circumferential speed, the amount of grinding is about the same as at the outer periphery. As a result, the amount of grinding of the intermediate portion (between the center portion and the peripheral portion) has been found to be the lowest.

Figure 2:
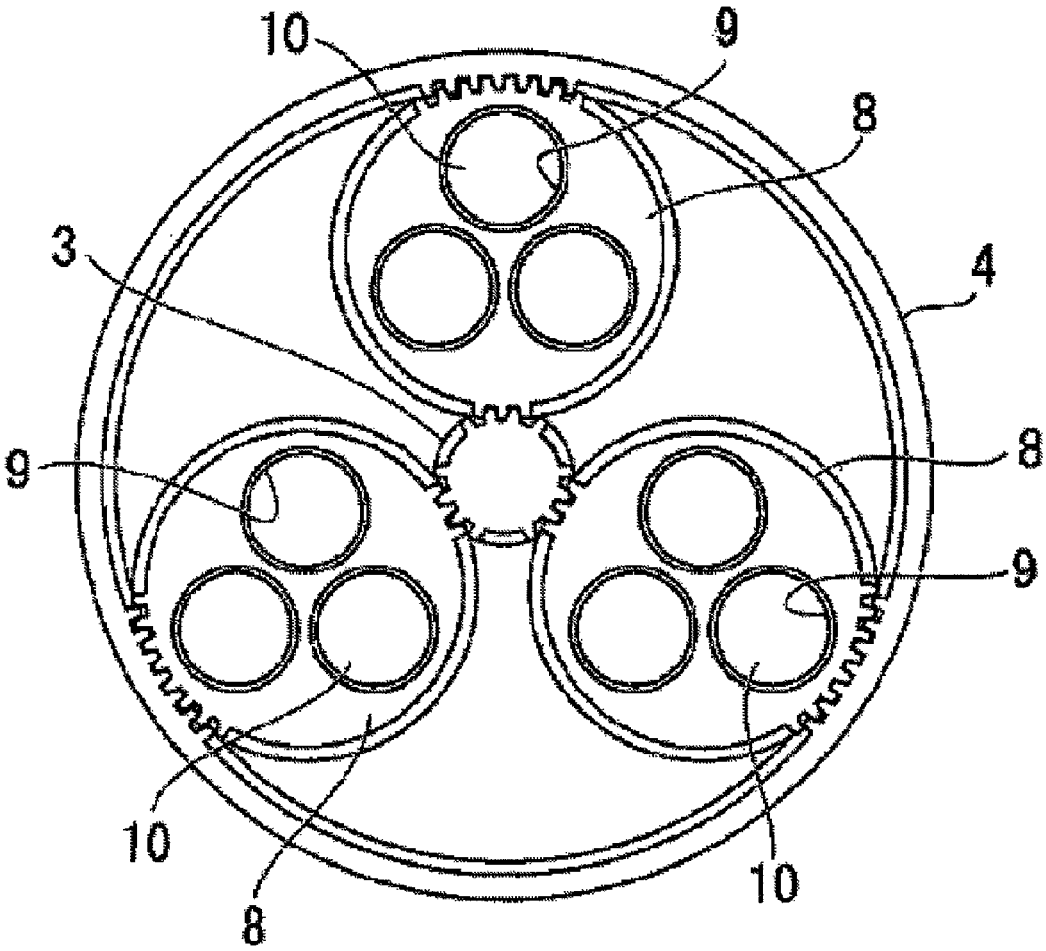
FIG. 2 is a plan view along section line A-A in FIG. 1.

Accordingly, in according to a non-limiting feature of the present invention, to correct for differences in grinding efficiency at the center portion, intermediate portion, and outer peripheral portion, larger pellets are provided in the center portion and peripheral portion than in the intermediate portion. For example, as shown in FIG. 4-2, the pellets provided in the center portion and peripheral portion are large, as indicated at the upper right, while the pellets provided in the intermediate portion are small, as indicated at the upper left. The larger the pellets, the lower the grinding efficiency. Thus, providing larger pellets in the center portion and in the peripheral portion than in the intermediate portion can increase flatness. The area ratio in FIG. 4-2 is 6 percent for the center portion, 52 percent for the intermediate portion, and 42 percent for the outer peripheral portion.

The pellets are disposed in grid-like fashion on the fixed abrasive grain surfaces of the surface plates. However, the planar shape of the pellets is not limited, and may be square, rectangular, polygonal (triangular, hexagonal, octagonal, or the like), round, or elliptical, for example. Pellets of such shapes are arranged at a prescribed spacing into a grid. The spacing between pellets can be suitably determined by those of skill in the art by taking into account the capacity to discharge grinding debris and the density of the pellets. Further, pellets of different planar shapes can be provided on the fixed abrasive grain surface of a single surface plate by taking into account differences in grinding efficiency based on pellet shape.

For example, when the pellets are of square planar shape, the length of one side of the pellets provided in the center and peripheral portions can be suitably determined based on cutting efficiency from within a range of 1.1 to 10-times the length of one side of the pellets provided in the intermediate portion.

As a further example, the radial ratio of the center portion, intermediate portion, and peripheral portion regions of the fixed abrasive grain surfaces of the surface plates on which pellets of different sizes are provided can range from 1:0.5 to 2:0.5 to 2 (center portion: intermediate portion: peripheral portion). The amount of grinding will vary in the center portion, in the intermediate portion and in the peripheral portion based on the conditions set for the grinding method, as well as based on the wafer diameter. The radial ratio can be suitably determined by considering such factors.

An embodiment of implementing the grinding method and semiconductor wafer grinding device employed in a non-limiting feature of the present invention will be described based on the drawings. FIG. 1 is a front view describing the semiconductor wafer grinding device, and FIG. 2 is a plan view along section line A-A in FIG. 1.

As indicated in FIGS. 1 and 2, the semiconductor wafer grinding device can be equipped with a horizontally supported ring-shaped lower surface plate (rotating surface plate) 1, a ring-shaped upper surface plate (rotating surface plate) 2 opposing lower surface plate 1 from above, a sun gear 3 positioned to the inside of ring-shaped lower surface plate 1, and a ring-shaped inner-toothed gear 4 positioned outside lower surface plate 1.

A motor 11 drives rotation of lower surface plate 1. Upper surface plate 2 is suspended via a joint 6 from a cylinder 5, and is driven to rotate in the opposite direction by a separate motor from the motor 11 driving lower surface plate 1. An alkali solution feeding part, including a tank 7 for feeding alkali solution between upper surface plate 2 and lower surface plate 1, is also provided. Both sun gear 3 and inner-toothed gear 4 are independently driven to rotate by a motor 12 separate from the motors driving the surface plates.

Fixed abrasive grains are provided on the opposing surfaces of lower surface plate 1 and upper surface plate 2. Lower surface plate 1 and upper surface plate 2 can be a surface plate according to the second aspect of the present invention.

Multiple carriers 8 are set on lower surface plate 1 so as to surround sun gear 3. The various carriers 8 that are set in place mesh to the inside with sun gear 3 and to the outside with inner-toothed gear 4. Holes 9 receiving semiconductor wafers (works or workpieces) 10 are provided eccentrically in each of carriers 8. The thickness of each of carriers 8 is set to be either identical to the target value for the final finished thickness of wafers 10, or to be slightly smaller.

To grind wafers 10, multiple carriers 8 are set onto lower surface plate 1 with upper surface plate 2 in a raised state, and wafers 10 are set in holes 9 in each of carriers 8. Upper surface plate 2 is lowered, and a prescribed pressure is applied to each of wafers 10. In this state, while feeding grinding solution between lower surface plate 1 and upper surface plate 2, each of lower surface plate 1, upper surface plate 2, sun gear 3, and inner-toothed gear 4 is rotated at a prescribed speed in a prescribed direction.

Thus, multiple carriers 8 between upper surface plate 1 and lower surface plate 2 undergo planetary motion, in which they revolve around sun gear 3, while rotating. The wafers 10 held on each of carriers 8 contact the fixed abrasive grains above and below in the presence of the alkali solution, simultaneously grinding both the upper and lower surfaces thereof. The grinding conditions can be set so that both surfaces of wafers 10 are uniformly ground and all of multiple wafers 10 are uniformly ground.

During grinding, the torque of motor 11 driving lower surface plate 1, or the torque of the motor driving upper surface plate 2, can be monitored. When this torque drops by a preset ratio—10 percent, for example—after having assumed a stable level, upper surface plate 2 can be raised to finish grinding. Thus, the final finished thickness of wafers 10 can be stably managed with high precision to be slightly thinner than or identical to the thickness of the carrier before grinding.

Since the carriers 8 may deteriorate due to friction with the surface plates, the material of the carriers 8 desirably has high resistance to abrasion and a low coefficient of friction with the fixed abrasive grains, and is desirably highly chemically resistant, for example, in pH 12 to 15 alkali solutions. Examples of carrier materials satisfying such conditions are stainless steel, epoxy resin, phenol resin, and polyimide resin. Further examples include but are not limited to FRPs (fiber-reinforced plastics) including such resins reinforced with a fiber such as glass fiber, carbon fiber, or aramid fiber. Since carriers 8 are employed to hold wafers 10, they cannot decrease much in strength.

Figure 3:
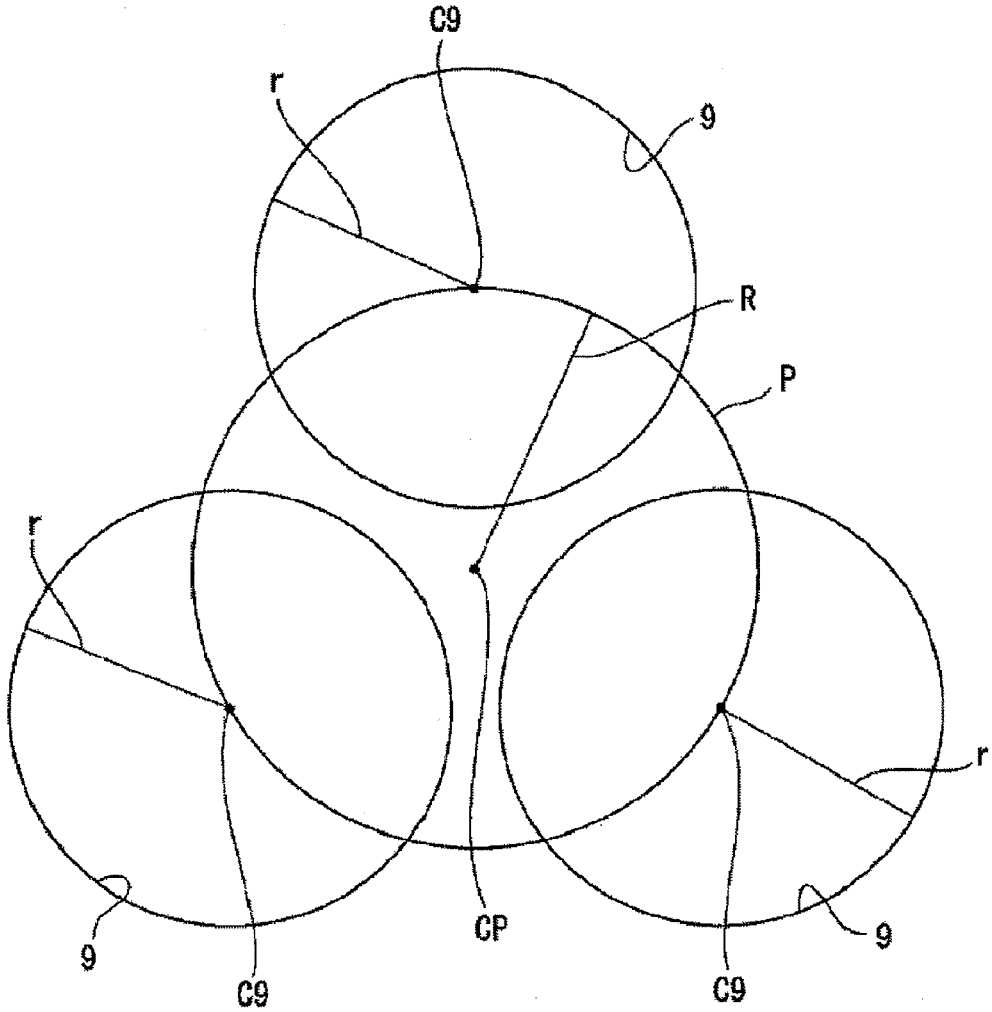
FIG. 3 is a plan view descriptive of an implementation embodiment of the semiconductor wafer grinding method according to a non-limiting feature of the present invention and of the disposition of holes in a carrier.

FIG. 3 is a plan view descriptive of the semiconductor wafer grinding method and disposition of holes in the carrier in the present implementation embodiment.

Multiple holes 9 are provided as shown in FIG. 3 in a carrier 8; there are three such spots in the present implementation embodiment.

In carrier 8 of the present implementation embodiment, the centers C9 of each of the three holes 9 are positioned on the circumference of a circle P that is concentric with carrier 8 and disposed at equal intervals on circle P so as to be rotationally symmetric about a point relative to center CP (the center of carrier 8) of circle P. The size of holes 9 is such that the ratio of the area of circle P passing through centers C9 of holes 9 to the area of one of holes 9, each of which is nearly equal in area to wafers 10, is greater than or equal to 1.33 but less than 2.0, preferably greater than or equal to 1.33 but less than or equal to 1.5.

That is, the radius R of circle P and the radius r of hole 9 are set so that:

$$1.33\ldots<(R/r)^2\leqq 1.5$$

The lower limit of the range specified by this area ratio (radius ratio squared) need only be greater than or equal to 1.3333 . . . , and may be greater than or equal to 1.334.

A ratio of the area of circle P passing through the centers C9 of holes 9 in carrier 8 to the area of one of holes 9 that falls below the above range is undesirable in that only two holes 9 can be provided within a carrier 8, the wafers processed in a single carrier 8 cannot be uniformly processed, and no effect is realized in preventing sagging of wafers 10. An upper limit of the above ratio of areas of greater than or equal to 2 is undesirable in that when holes 9 are provided in three spots in carrier 8, the distance between wafers 10 becomes excessive and no effect is realized in preventing sagging of wafers 10. An upper limit of the above ratio of areas of greater than or equal to 2 is undesirable in that when four or more holes 9 are provided in carrier 8, the pressure that concentrates is not adequately dispersed, precluding a preventive effect on sagging of wafers 10. Although sagging can be prevented when the upper limit of the above ratio of areas is set to greater than 1.5 but less than 2, less than or equal to 1.5 is desirable for obtaining finished product wafers of adequate flatness.

The size of wafer 10 and hole 9 can be roughly identical. When wafer 10 is 200 mm in diameter, hole 9 can be 201 mm in diameter, and when wafer 10 is 300 mm in diameter, hole 9 can be 302 mm in diameter.

In the present implementation embodiment, as set forth above, the use of carriers 8, in which holes 9 are formed, to grind both surfaces of wafers 10 makes it possible to manufacture polished wafers of a high degree of flatness.

According to the present implementation embodiment, reducing the distance between semiconductor wafers 10 that are being ground on both surfaces to bring wafers 10 close together makes it possible to grind each of the wafers 10 positioned in holes 9 in three spots on a single carrier 8 in a manner approaching that achieved when grinding a single wafer 10. Thus, according to the present implementation embodiment, it is possible to keep the length over which pressure concentrates to just part of the total length of the perimeter of a single wafer 10, that is, to reduce the concentration of pressure in the perimeter portion of wafer 10 from flexible pads on the surfaces of surface plates 1 and 2 due to the difference in thickness of wafer 10 and carrier 8, resulting in reduction of portions significantly ground in the perimeter portion of wafer 10. Thus, it is possible to alleviate the concentration of grinding pressure over the entire circumference of the perimeter portion in a single wafer 10 when grinding is completed, which is thought to permit a reduction in the sagging produced in the perimeter portion in individual wafers 10.

In the present implementation embodiment, three carriers 8 are configured. However, fewer or greater suitable numbers of carriers 8 are possible. Additionally, so long as the disposition of holes 9 or wafers 10 in each carrier 8 is configured as set forth above, various configurations of the grinding device are possible.

Wafer 10 can be a silicon wafer or a wafer of some other semiconducting material. A non-limiting feature of present invention can be applied to wafers with diameters of 200 mm, 300 mm, as well as 450 mm or the like. The method and device according to a non-limiting feature of the present invention are particularly suited to the grinding of large silicon wafers 400 to 500 mm in diameter.

EXAMPLES

The present invention will be described in detail below based on examples. However, the present invention is not limited to the examples.

Grinding devices configured as described above and carriers of different ratios of areas of circle P and holes 9 were prepared. These carriers were used to grind semiconductor wafers (silicon wafers) 10 and the flatness thereof was measured after grinding.

Details of grinding conditions and the like are indicated below.

| | |
|---|---|
| Wafer subjected to grinding: | 450 mm silicon wafer |
| Grinding device: | 20B dual-surface grinder made by Speed Fam |
| Fixed abrasive grains: | Diamond |
| Alkali solution: | pH 14 |
| Grinding pressure: | 200 g/cm$^2$ |
| Carrier: | Made of stainless steel |
| Number of wafers ground: | 5 carriers respectively having 3 holes (total 15 wafer batch) |
| Area ratios of circle P to hole 9: | 138%, 144%, 150%, 163% |

Figure 5:
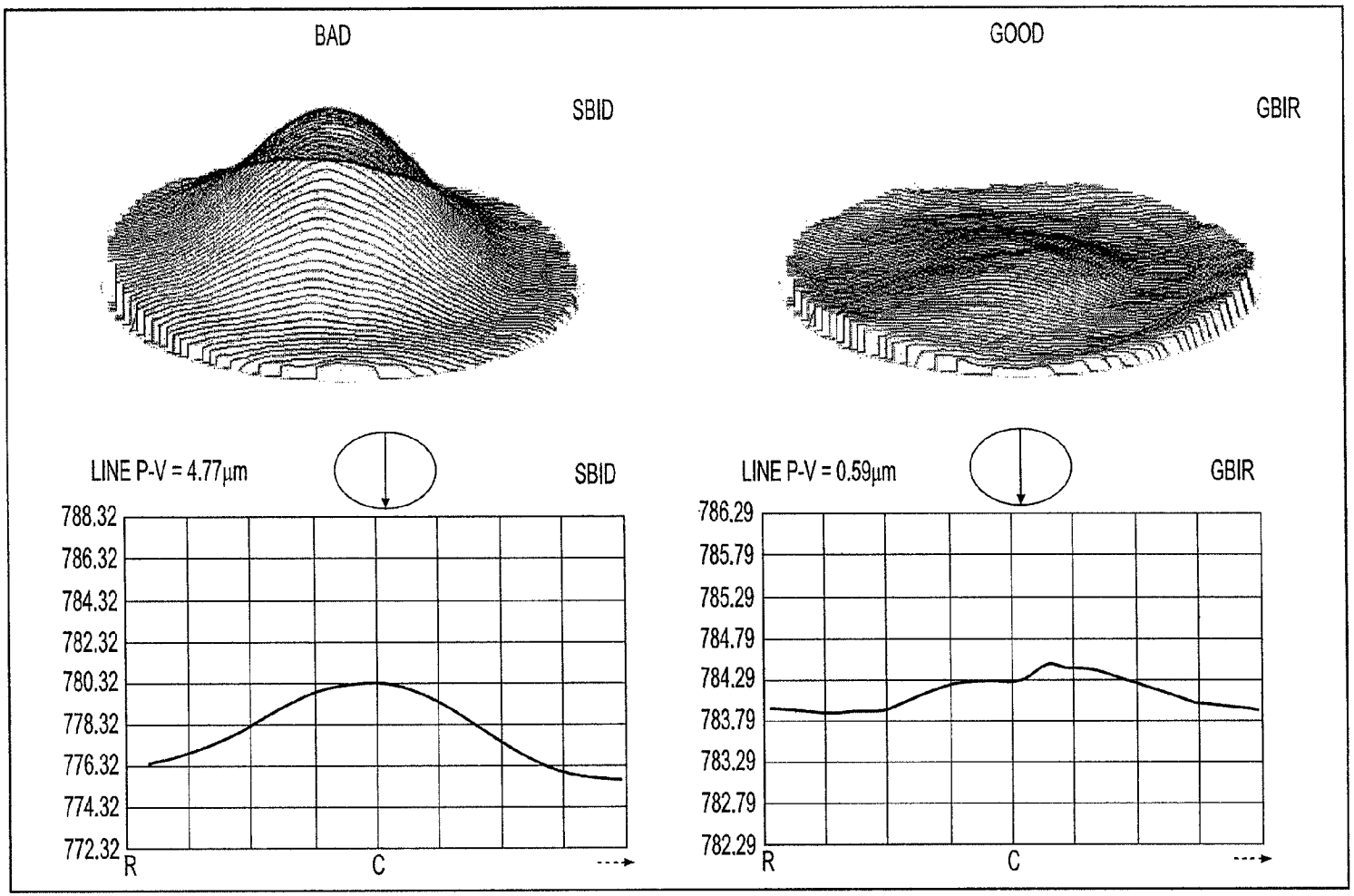
FIG. 5 shows exemplary results of flatness measurement.

Following grinding, flatness (TTV: total thickness variation (micrometers)) was measured with an ADE (electrostatic capacitance surface flatness measuring device). The results are given in FIG. 5. The example of the present invention is shown on the right (good); a conventional example is shown on the left (bad).

The present invention is useful in the field of semiconductor wafer manufacturing.

Although the present invention has been described in considerable detail with regard to certain versions thereof, other versions are possible, and alterations, permutations and equivalents of the version shown will become apparent to those skilled in the art upon a reading of the specification and study of the drawings. Also, the various features of the versions herein can be combined in various ways to provide additional versions of the present invention. Furthermore, certain terminology has been used for the purposes of descriptive clarity, and not to limit the present invention. Therefore, any appended claims should not be limited to the description of the preferred versions contained herein and should include all such alterations, permutations, and equivalents as fall within the true spirit and scope of the present invention.

Having now fully described this invention, it will be understood to those of ordinary skill in the art that the methods of the present invention can be carried out with a wide and equivalent range of conditions, formulations, and other parameters without departing from the scope of the invention or any embodiments thereof.

All patents and publications cited herein are hereby fully incorporated by reference in their entirety. The citation of any publication is for its disclosure prior to the filing date and should not be construed as an admission that such publication is prior art or that the present invention is not entitled to antedate such publication by virtue of prior invention.

What is claimed is:

1. A method of grinding semiconductor wafers, comprising:

simultaneously grinding both surfaces of multiple semiconductor wafers being ground by rotating the multiple semiconductor wafers between a pair of upper and lower rotating surface plates in a state where the multiple semiconductor wafers are held on a carrier such that centers of the multiple semiconductor wafers are positioned on a circumference of a single circle, wherein:

a ratio of an area of a circle passing through the centers of the multiple semiconductor wafers to an area of one of the multiple semiconductor wafers is greater than or equal to 1.33 but less than 2.0;

the rotating surface plates comprise fixed abrasive grains; and surfaces of the fixed abrasive grains are comprised of pellets disposed in a grid-like fashion, with the pellets provided in a center portion and pellets provided in a peripheral portion being larger in size than the pellets provided in an intermediate portion between the center portion and the peripheral portion.

2. The method of grinding according to claim 1, wherein the pellets are of square planar shape, and a length of one side of the pellets provided in the center and peripheral portions ranges from 1.1 to 10 times a length of one side of the pellets provided in the intermediate portion.

3. The method of grinding according to claim 1, wherein a radial ratio of the center portion, intermediate portion, and peripheral portion ranges from 1:0.5 to 2:0.5 to 2 (center portion: intermediate portion: peripheral portion).

4. The method of grinding according to claim 1, wherein the semiconductor wafers have a diameter ranging from 400 to 500 mm.

5. A semiconductor wafer grinding surface plate comprising fixed abrasive grains, wherein, surfaces of the fixed abrasive grains facing a surface of a semiconductor wafer are comprised of grid-like pellets, and the pellets provided in a center portion and peripheral portion are larger in size than the pellets provided in an intermediate portion between the center portion and the peripheral portion.

6. The semiconductor wafer grinding surface plate according to claim 5, wherein the pellets are of square planar shape, and a length of one side of the pellets provided in the center and peripheral portions ranges from 1.1 to 10 times a length of one side of the pellets provided in the intermediate portion.

7. The semiconductor wafer grinding surface plate according to claim 5, wherein a radial ratio of the center portion, intermediate portion, and peripheral portion ranges from 1:0.5 to 2:0.5 to 2 (center portion: intermediate portion: peripheral portion).

8. A semiconductor wafer grinding device comprising:

a pair of upper and lower rotating surface plates;

a sun gear provided in a rotating center portion between the upper and lower rotating surface plates;

a ring-shaped inner-toothed gear positioned on an outer circumference portion between the upper and lower rotating surface plates; and a carrier comprising a planetary gear, the planetary gear meshing with the inner-toothed gear and sun gear and being positioned between the upper and lower rotating surface plates, wherein:

the carrier has multiple holes configured to receive respective wafers being ground, centers of the multiple holes are positioned on a circumference of a single circle, with a ratio of an area of a circle passing through the centers of the multiple holes to an area of one of wafers being ground greater than or equal to 1.33 but less than 2.0, and the rotating surface plates are the surface plate according to claim 5.

* * * * *

UNITED STATES PATENT AND TRADEMARK OFFICE

CERTIFICATE OF CORRECTION

PATENT NO. : 8,092,277 B2
APPLICATION NO. : 12/470714
DATED : January 10, 2012
INVENTOR(S) : T. Hashii et al.

It is certified that error appears in the above-identified patent and that said Letters Patent is hereby corrected as shown below:

On the title page, item (56) References Cited, Foreign Patent Documents, Column 2, Line 4, please delete duplicate reference "JP 2009-4616 1/2009".

Signed and Sealed this
Eighteenth Day of September, 2012

David J. Kappos

David J. Kappos
*Director of the United States Patent and Trademark Office*